US008080724B2

(12) United States Patent
Kim et al.

(10) Patent No.: US 8,080,724 B2
(45) Date of Patent: Dec. 20, 2011

(54) METHOD AND SYSTEM FOR SEPARATING MUSICAL SOUND SOURCE WITHOUT USING SOUND SOURCE DATABASE

(75) Inventors: Min Je Kim, Daejeon (KR); Seung Kwon Beack, Seoul (KR); Kyeongok Kang, Daejeon (KR); Dae Young Jang, Daejeon (KR); Tae Jin Lee, Daejeon (KR); Inseon Jang, Daejeon (KR); Jin Woo Hong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 106 days.

(21) Appl. No.: 12/748,831

(22) Filed: Mar. 29, 2010

(65) Prior Publication Data

US 2011/0061516 A1 Mar. 17, 2011

(30) Foreign Application Priority Data

Sep. 14, 2009 (KR) ..... 10-2009-0086499
Dec. 10, 2009 (KR) ..... 10-2009-0122218

(51) Int. Cl.
*G10H 1/00* (2006.01)
*G10H 1/18* (2006.01)
*G10H 7/00* (2006.01)

(52) U.S. Cl. ..... 84/615; 84/635; 702/196

(58) Field of Classification Search ..... 702/190, 702/196; 84/615, 617, 618, 635
See application file for complete search history.

(56) References Cited

U.S. PATENT DOCUMENTS

| | | | | |
|---|---|---|---|---|
| 7,415,392 | B2 * | 8/2008 | Smaragdis | 702/190 |
| 7,912,232 | B2 * | 3/2011 | Master | 381/94.3 |
| 2005/0222840 | A1 * | 10/2005 | Smaragdis | 704/204 |
| 2009/0132245 | A1 | 5/2009 | Wilson et al. | |
| 2010/0138010 | A1 * | 6/2010 | Aziz Sbai et al. | 700/94 |
| 2011/0054848 | A1 * | 3/2011 | Kim et al. | 702/190 |

* cited by examiner

*Primary Examiner* — Jeffrey Donels
(74) *Attorney, Agent, or Firm* — Ladas & Parry LLP

(57) ABSTRACT

Provided are an apparatus and method of separating, from a mixed signal, a sound source generated using a rhythm musical instrument based on characteristics of the rhythm musical instrument repeated in an aspect of time. The apparatus may include a separation unit to separate a plurality of mixed signals into a plurality of segments, a Nonnegative Matrix Partial Co-Factorization (NMPCF) analysis unit to perform an NMPCF analysis on the plurality of segments, and to obtain a plurality of entity matrices based on the analysis result, a target instrument signal separating unit to separate, from the mixed signals, a target instrument signal, by calculating an inner product between the plurality of entity matrices, and a signal association unit to associate the target instrument signals separated from each of the plurality of segments.

10 Claims, 3 Drawing Sheets

METHOD AND SYSTEM FOR SEPARATING MUSICAL SOUND SOURCE WITHOUT USING SOUND SOURCE DATABASE

CROSS-REFERENCE TO RELATED APPLICATIONS

This application claims the benefit of Korean Patent Application No. 10-2009-0086499, filed on Sep. 14, 2009, and No. 10-2009-0122218, filed on Dec. 10, 2009, in the Korean Intellectual Property Office, the disclosures of which are incorporated herein by reference.

BACKGROUND

1. Field of the Invention

Embodiments of the present invention relate to a method of separating a musical sound source, and more particularly, to an apparatus and method of separating, from a mixed signal, a sound source generated using a rhythm musical instrument based on characteristics of the rhythm musical instrument repeated in an aspect of time when sound source information generated only using the rhythm musical instrument is present.

2. Description of the Related Art

Along with developments in technologies, a method of separating only a sound generated using a rhythm musical instrument from an ensemble where various musical instruments are performing has been developed.

However, in a conventional method of separating sound sources, the sound sources may be separated utilizing statistical characteristics of the sound sources based on a model of an environment where signals are mixed, and thus only mixed signals having a same number of sound sources to be separated as a number of sound sources in the model may be applicable, or construction of a learning database with respect to the sound sources to be separated may be needed.

Accordingly, there is a need for a method of separating a specific sound source even in a state where a database comprised of only the specific sound source is not provided.

SUMMARY

An aspect of the present invention provides an apparatus of separating a musical sound source, which may separate a sound source generated using a rhythm musical instrument based on characteristics of the rhythm musical instrument repeated in an aspect of time, and thereby may separate a sound source included in a mixed signal even when a learning database generated using a specific sound source is absent.

According to an aspect of the present invention, there is provided an apparatus of separating musical sound sources, the apparatus including: a separation unit to separate a plurality of mixed signals into a plurality of segments; a Nonnegative Matrix Partial Co-Factorization (NMPCF) analysis unit to perform an NMPCF analysis on the plurality of segments, and to obtain a plurality of entity matrices based on the analysis result; a target instrument signal separating unit to separate, from the mixed signals, a target instrument signal, by calculating an inner product between the plurality of entity matrices; and a signal association unit to associate the target instrument signals separated from each of the plurality of segments.

In this instance, the plurality of entity matrices obtained by the NMPCF analysis unit may include a matrix $A_C$ of a frequency element commonly shared by all of the plurality of segments, a matrix $A_I^{(l)}$ of a different frequency element for each of the plurality of segments, an information matrix $S_C^{(l)}$ of the time domain corresponding to $A_C$, and an information matrix $S_I^{(l)}$ of the time domain corresponding to $A_1^{(l)}$.

Also, the apparatus may further include a time-frequency domain conversion unit to receive the mixed signal of a time domain, to convert the received mixed signal of the time domain into a mixed signal of a time-frequency domain to transmit the converted signal to the NMPCF analysis unit, and to extract phase information from the received mixed signal of the time domain and a specific sound source signal; and a time domain signal conversion unit to convert the phase information and the approximate value of the magnitude spectrogram to obtain the sounds generated using the predetermined rhythm musical instrument.

According to an aspect of the present invention, there is provided a method of separating a musical sound source, the method including: receiving a mixed signal of a time domain; converting the received mixed signal of the time domain into a mixed signal of a time-frequency domain, and extracting phase information from the received mixed signal of the time domain; separating the mixed signal of the time-frequency domain into a plurality of segments; performing an NMPCF analysis on the plurality of segments; obtaining a plurality of entity matrices based on the NMPCF analysis result; separating a target instrument signal from the mixed signal separated into the plurality of segments by calculating an inner product between the plurality of entity matrices; associating the target instrument signals separated from each of the plurality of segments; and converting the associated target instrument signal and the phase information into a signal of the time domain to separate, from the mixed signal, sounds generated using a predetermined rhythm musical instrument.

Additional aspects, features, and/or advantages of the invention will be set forth in part in the description which follows and, in part, will be apparent from the description, or may be learned by practice of the invention.

EFFECT

According to embodiments of the present invention, there is provided an apparatus of separating a musical sound source, which may separate a sound source generated using a rhythm musical instrument based on characteristics of the rhythm musical instrument repeated in an aspect of time, and thereby may separate a sound source included in a mixed signal even when a learning database generated using a specific sound source is absent.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
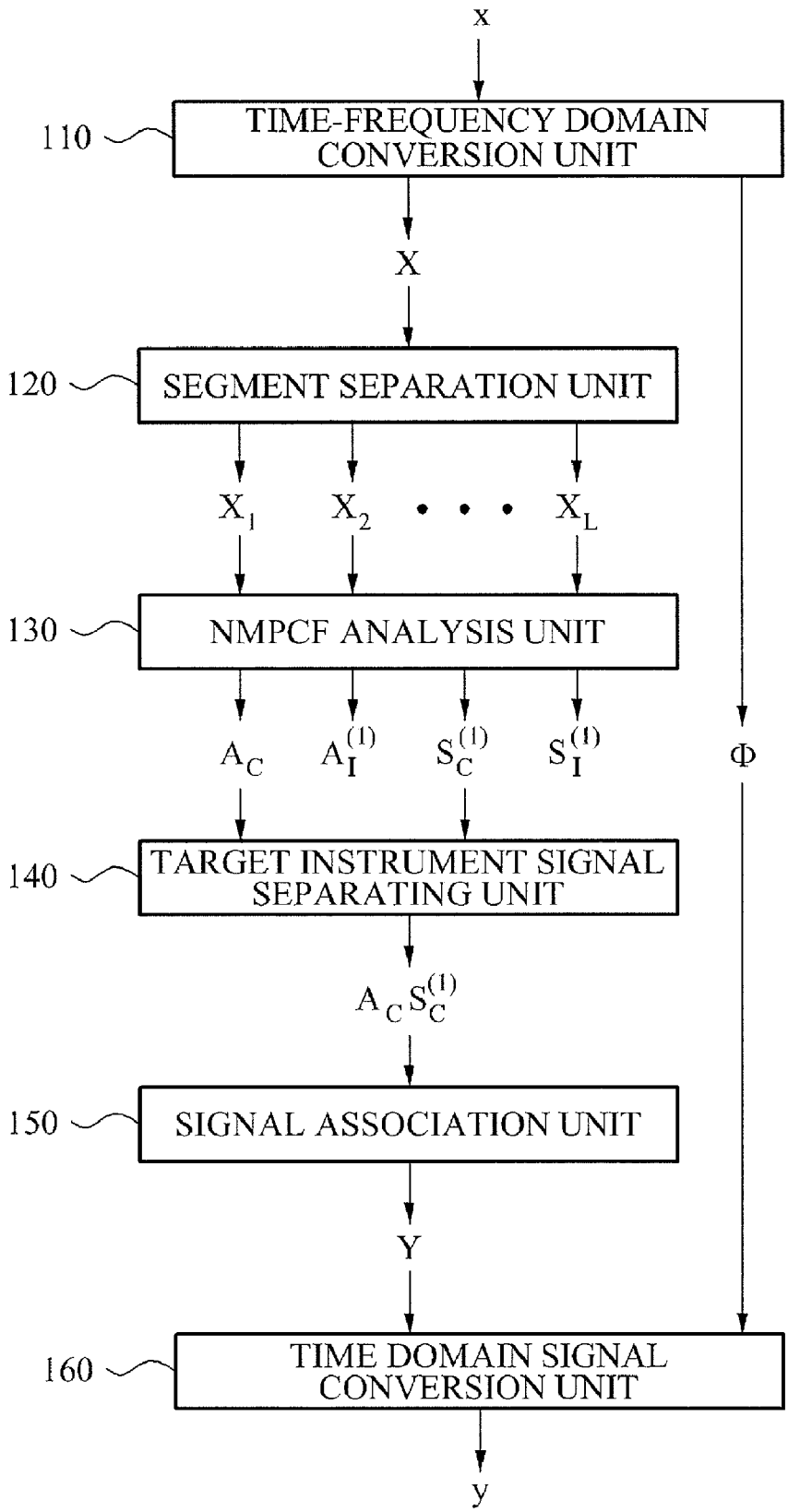
FIG. 1 illustrates an example of an apparatus of separating a musical sound source according to an embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 illustrates an example of an apparatus of separating a musical sound source according to an embodiment of the present invention.

As illustrated in FIG. 1, the apparatus includes a time-frequency domain conversion unit 110, a segment separation unit 120, a Nonnegative Matrix Partial Co-Factorization (NMPCF) analysis unit 130, a target instrument signal separating unit 140, a signal association unit 150, and a time domain signal conversion unit 160.

The time-frequency domain conversion unit 110 may receive a mixed signal x of a time domain inputted from a user, and convert the received mixed signal x of the time domain into a mixed signal of a time-frequency domain. In this instance, the mixed signal may be a musical signal where performances of various musical instruments or voices are mixed.

Also, the time-frequency domain conversion unit 110 may extract phase information Φ from the received mixed signal x.

In this instance, the time-frequency domain conversion unit 110 may transmit, to the NMPCF analysis unit 130, a magnitude X of the converted mixed signal, and transmit the phase information Φ to the time domain signal conversion unit 160.

The segment separation unit 120 may separate the mixed signal converted in the time-frequency domain conversion unit 110 into a plurality of segments.

Specifically, the segment separation unit 120 may separate the magnitude X of the mixed signal into L number of consecutive segments $X^{(1)}, X^{(2)}, \ldots, X^{(L)}$.

The NMPCF analysis unit 130 may perform an NMPCF analysis on the plurality of segments separated in the segment separation unit 120, and obtain a plurality of entity matrices based on the analysis result.

Specifically, the NMPCF analysis unit 130 may designate a specific segment $X^{(l)}$ as relationship between entity matrices $A^{(l)}$ and $S^{(1)}$ that is, as a product of the entity matrices $A^{(l)}$ and $S^{(l)}$.

In this instance, the entity matrix $A^{(l)}$ may be separated into an element $A_C$ commonly used by a plurality of input matrices and an element $A_I^{(l)}$ separately used in each of the plurality of input matrices. In this instance, when the element separately used in the specific segment $X^{(l)}$ is absent, $A^{(l)}=A_C$ may be satisfied.

The NMPCF analysis unit 130 may obtain the segment $X^{(l)}$ using the following Equation 1 of an optimized target function.

$$\mathcal{J}_{NMPCF} = \sum_{l=1}^{L} \lambda_l \|X^{(l)} - A_C S_C^{(l)} - A_I^{(l)} S_I^{(l)}\|_F^2 + \gamma \left\{ \sum_{l=1}^{L} \|A^{(l)}\|_F^2 \right\}, \quad \text{[Equation 1]}$$

where L denotes a number of a plurality of input matrices, $\lambda_l$ denotes a degree in which restoration of a specific input matrix influences the optimized target function, and γ denotes a parameter of adjusting a degree of regularization. Also, $A_C$ denotes a matrix of a frequency element commonly shared by all of the plurality of segments, $A_I^{(l)}$ denotes a different frequency element for each of the plurality of segments, $S_C^{(l)}$ denotes an information matrix of the time domain corresponding to $A_C$, and $S_I^{(l)}$ denotes an information matrix of the time domain corresponding to $A_C^{(l)}$.

Also, the NMPCF analysis unit 130 may update $A_C$, $A_I^{(l)}$, and $S_I^{(l)}$ in accordance with an NMPCF algorithm by applying to the $A_C$, $A_I^{(l)}$, and $S_I^{(l)}$ to the following Equation 2 to thereby obtain entity matrices $A_C$, $A_I^{(l)}$, $S_C^{(l)}$, and $S_I^{(l)}$ that may minimize the optimized target function of Equation 1.

$$S^{(l)} \leftarrow S^{(l)} \odot \left( \frac{A^{(l)\top} X^{(l)}}{A^{(l)\top} A^{(l)} S^{(l)}} \right)^{\eta}, \quad \text{[Equation 2]}$$

$$A_C \leftarrow A_C \odot \left( \frac{\sum_l \lambda_l X^{(l)} S_C^{(l)\top}}{\sum_l \lambda_l A^{(l)} S^{(l)} S_C^{(l)\top} + \gamma L A_C} \right)^{\eta},$$

$$A_I^{(l)} \leftarrow A_I^{(l)} \odot \left( \frac{\lambda_l X^{(l)} S_I^{(l)\top}}{\lambda_l A^{(l)} S^{(l)} S_I^{(l)\top} + \gamma A_I^{(l)}} \right)^{\eta},$$

where $(\ )^{-\eta}$ denotes a square of an element unit of a matrix in a range of '0' to '1', and may be a parameter of adjusting a speed of an update operation.

That is, the NMPCF analysis unit 130 may initialize $A_C$, $A_I^{(l)}$, $S_C^{(l)}$, and $S_I^{(l)}$ in accordance with the NMPCF algorithm to be non-negative real numbers, and repeatedly update the initialized $A_C$, $A_I^{(l)}$, $S_C^{(l)}$, and $S_I^{(l)}$ based on Equation 2 until approaching a predetermined value.

In this instance, multiplicative characteristics of Equation 2 may not change signs of elements included in the entity matrices.

The NMPCF analysis unit 130 may obtain info nation shared by the plurality of segments in accordance with the NMPCF algorithm. In this instance, a rhythm instrument signal may have frequency characteristics such as a pitch, that may not be easily changed, and may be repeatedly generated, whereby the shared information may correspond to information of a rhythm musical instrument.

The target instrument signal separating unit 140 may separate a target instrument signal corresponding to a specific sound source from the mixed signal by calculating an inner product between the entity matrices obtained by the NMPCF analysis unit 130. In this instance, the target instrument signal may be a signal including sounds generated using the rhythm musical instrument.

Specifically, the target instrument signal separating unit 140 may separate the target instrument signal from the mixed signal separated for each of the plurality of segments by calculating an inner product between the entity matrices $A_C$ and $S_C^{(l)}$, and convert the separated target instrument signal into an approximation signal $A_C S_C^{(l)}$ expressed in a magnitude unit of a time-frequency domain.

The signal association unit 150 may associate the target instrument signals for each of the plurality of segments separated in the target instrument signal separating unit 140.

Specifically, the signal association unit 150 may sequentially re-associate the target instrument signals for each of the plurality of segments to thereby generate an approximation Y of a magnitude spectrogram X of the mixed signal.

The time domain signal conversion unit 160 may convert the approximation Y and the phase information Φ into a signal of a time domain to thereby obtain an approximation signal y of the target instrument signal.

In this instance, an instrument signal not being a target to be separated may be expressed as a product of a matrix $A_I^{(l)}$ of an unshared element and a corresponding encoding matrix $S_I^{(l)}$, however, a differential signal of an input signal x and a restored target signal y may be regarded as a restored signal of a chord musical instrument. In this instance, the instrument signal not being the target to be separated may be a musical signal of the chord musical instrument that may be not classified as the rhythm musical instrument.

Figure 2:
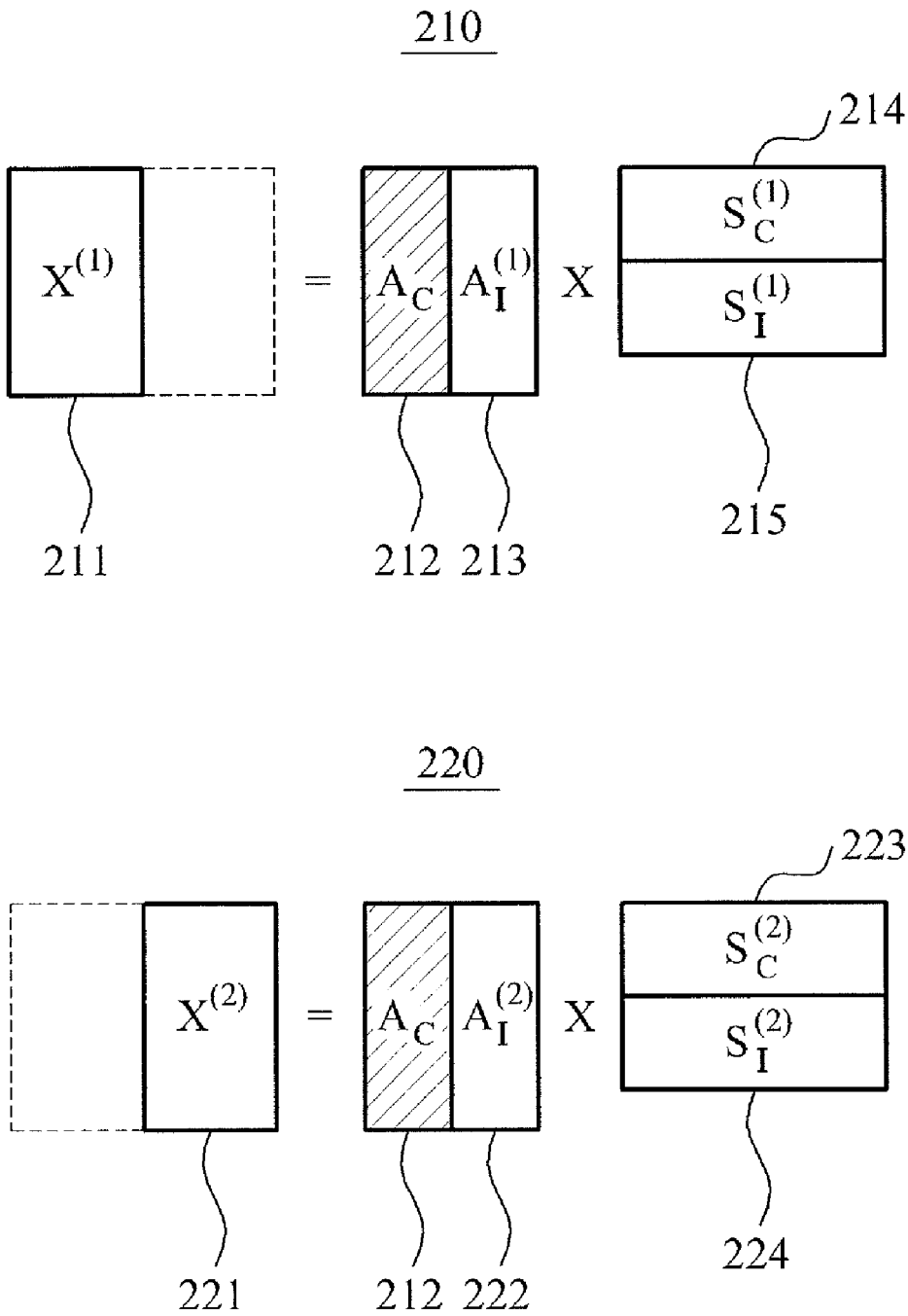
FIG. 2 illustrates an example of a state where a mixed signal is separated into two segments according to an embodiment of the present invention.

FIG. 2 illustrates an example of a state where a mixed signal is separated into two segments according to an embodiment of the present invention.

As illustrated in FIG. 2, a first segment $X^{(1)}$ 211 may include a matrix $A_C$ 212 of a frequency element commonly shared with a second segment 221, a matrix $A_I^{(1)}$ 213 of a unique frequency element of the first segment $X^{(1)}$ 211, an information matrix $S_C^{(1)}$ 214 of a time domain corresponding to $A_C$ 212 in the first segment $X^{(1)}$ 211, and an information matrix $S_I^{(1)}$ 215 of a time domain corresponding to $A_I^{(1)}$ 213.

Also, a second segment $X^{(2)}$ 221 may include $A_C$ 212, a matrix $A_I^{(2)}$ 222 of a unique frequency element of the second segment, an information matrix $S_C^{(2)}$ 223 of a time domain corresponding to $A_C$ 212 in the second segment $X^{(2)}$ 221, and an information matrix $S_I^{(2)}$ 224 of a time domain corresponding to $A_I^{(2)}$ 222.

Figure 3:
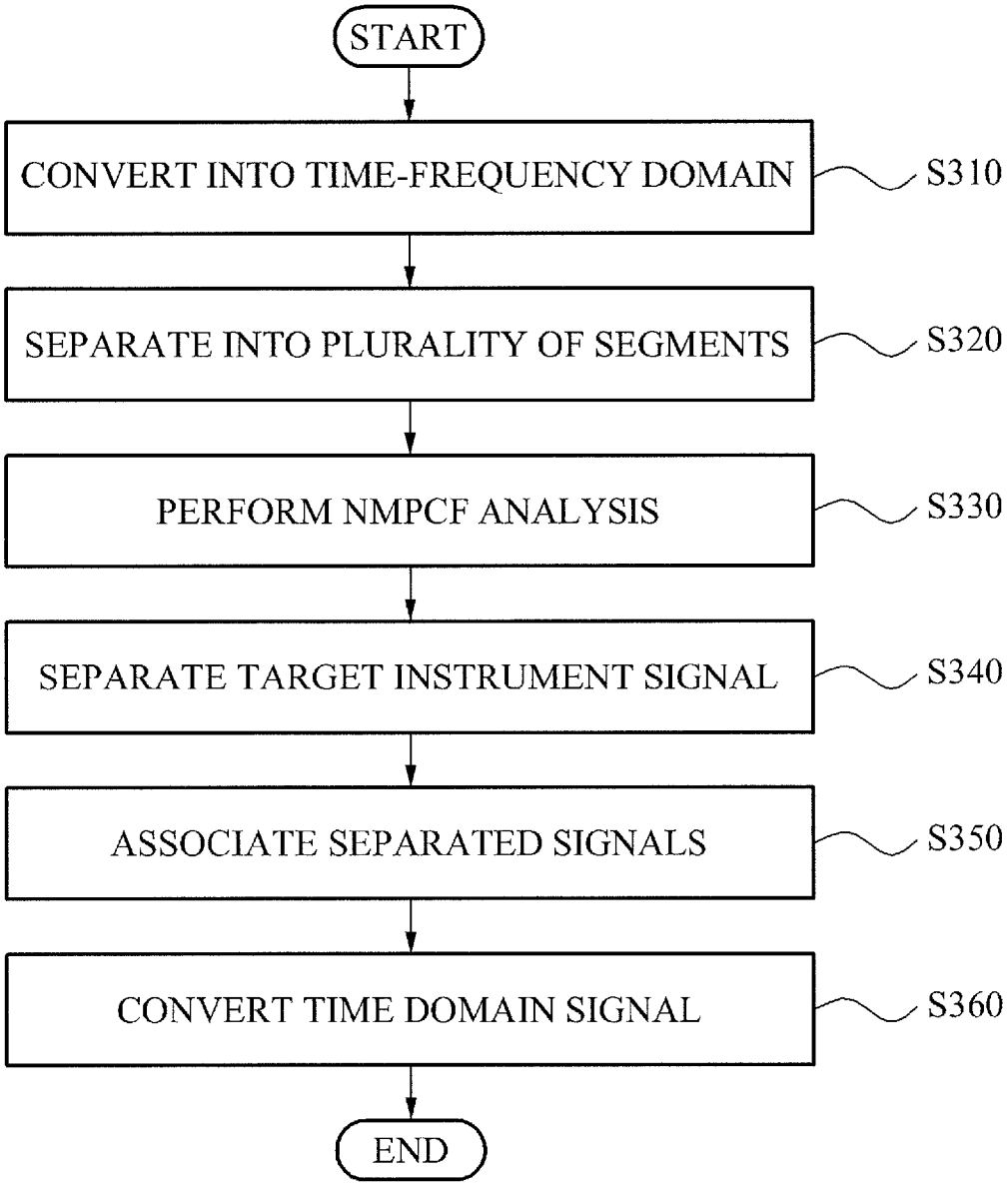
FIG. 3 is a flowchart illustrating a method of separating a musical sound source according to an embodiment of the present invention.

FIG. 3 is a flowchart illustrating a method of separating a musical sound source according to an embodiment of the present invention.

In operation S310, the time-frequency domain conversion unit 110 may receive a mixed signal of a time domain, and convert the received mixed signal of the time domain into a mixed signal of a time-frequency domain to thereby extract phase information from the received mixed signal of the time domain.

In operation S320, the segment separation unit 120 may separate the mixed signal converted in the time-frequency domain conversion unit 110 into a plurality of segments.

Specifically, the segment separation unit 120 may separate a magnitude X of the mixed signal into L number of consecutive segments $X^{(1)}, X^{(2)}, \ldots, X^{(L)}$.

In operation S330, the NMPCF analysis unit 130 may perform an NMPCF analysis on the plurality of segments separated in operation S320, and obtain a plurality of entity matrices based on the analysis result.

In this instance, the entity matrices obtained by the NMPCF analysis unit 130 may include a matrix $A_C$ of a frequency element commonly shared by all of the plurality of segments, a matrix of a different frequency element for each of the plurality of segments, an information matrix $S_C^{(l)}$ of the time domain corresponding to $A_C$, and an information matrix $S_I^{(l)}$ of the time domain corresponding to $A_I^{(l)}$.

In operation S340, the target instrument signal separating unit 140 may separate a target instrument signal from the mixed signal separated from each of the plurality of segments by calculating an inner product between the entity matrices obtained in operation S220.

Specifically, the target instrument signal separating unit 140 may separate the target instrument signal from the mixed signal separated for each of the plurality of segments by calculating an inner product between the entity matrices $A_C$ and $S_C^{(l)}$, and convert the separated target instrument signal into an approximation signal $A_C S_C^{(l)}$ expressed in a magnitude unit of a time-frequency domain.

In operation S350, the signal association unit 150 may associate the target instrument signals for each of the plurality of segments separated in operation S340.

Specifically, the signal association unit 150 may re-associate the target instrument signals for each of the plurality of segments to thereby generate an approximation Y of a magnitude spectrogram X of the mixed signal.

In operation S360, the time domain signal conversion unit 160 may convert the approximation Y and the phase information into an approximation signal y of the target instrument signal.

As described above, according to embodiments, there is provided an apparatus of separating a musical sound source, which may separate a sound source generated using a rhythm musical instrument based on characteristics of the rhythm musical instrument repeated in an aspect of time, and thereby may separate a sound source included in a mixed signal even when a learning database generated using a specific sound source is absent.

That is, according to embodiments, there is provided the apparatus of separating the musical sound source, which may separate a desired sound source from a single mixed signal, and thus may be applicable in separating commercial musical sounds obtaining only one or two mixed signals.

Also, according to embodiments, there is provided the apparatus of separating the musical sound source, which may separate a sound source generated using a rhythm musical instrument based on characteristics of the rhythm musical instrument repeated in an aspect of time, and thereby may readily separate the sound source even when a learning database obtained based on the characteristics of the rhythm musical instrument included in a mixed signal is difficult to be utilized.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. An apparatus of separating musical sound sources, the apparatus comprising:

a separation unit to separate a plurality of mixed signals into a plurality of segments;

a Nonnegative Matrix Partial Co-Factorization (NMPCF) analysis unit to perform an NMPCF analysis on the plurality of segments, and to obtain a plurality of entity matrices based on the analysis result;

a target instrument signal separating unit to separate, from the mixed signals, a target instrument signal, by calculating an inner product between the plurality of entity matrices; and a signal association unit to associate the target instrument signals separated from each of the plurality of segments.

2. The apparatus of claim 1, wherein the mixed signal is a musical signal where performances of various musical instruments or voices are mixed, and the target instrument signal is a signal including sounds generated using a predetermined rhythm musical instrument.

3. The apparatus of claim 2, wherein the plurality of entity matrices obtained by the NMPCF analysis unit includes a matrix $A_C$ of a frequency element commonly shared by all of the plurality of segments, a matrix $A_I^{(l)}$ of a different frequency element for each of the plurality of segments, an information matrix $S_C^{(l)}$ of the time domain corresponding to $A_C$, and an information matrix $S_I^{(l)}$ of the time domain corresponding to $A_I^{(l)}$.

4. The apparatus of claim 3, wherein the target instrument signal separating unit separates the target instrument signal from the plurality of mixed signals by calculating an inner product between $A_C$ and $S_C^{(l)}$, and converts the separated target instrument signal into an approximation signal expressed in a magnitude unit of a time-frequency domain.

5. The apparatus of claim 4, wherein the signal association unit sequentially associates the target instrument signals separated from each of the plurality of segments to generate an approximate value of a magnitude spectrogram of the mixed signal.

6. The apparatus of claim 5, further comprising:

a time-frequency domain conversion unit to receive the mixed signal of a time domain, to convert the received mixed signal of the time domain into a mixed signal of a time-frequency domain to transmit the converted signal to the NMPCF analysis unit, and to extract phase information from the received mixed signal of the time domain and a specific sound source signal; and a time domain signal conversion unit to convert the phase information and the approximate value of the magnitude spectrogram to obtain the sounds generated using the predetermined rhythm musical instrument.

7. The apparatus of claim 1, wherein the NMPCF analysis unit initializes the plurality of entity matrices to be a non-negative real number.

8. The apparatus of claim 1, wherein the NMPCF analysis unit updates values of the plurality of entity matrices in accordance with a method of updating an NMPCF algorithm.

9. A method of separating a musical sound source, the method comprising:

receiving a mixed signal of a time domain;

converting the received mixed signal of the time domain into a mixed signal of a time-frequency domain, and extracting phase information from the received mixed signal of the time domain;

separating the mixed signal of the time-frequency domain into a plurality of segments;

performing an NMPCF analysis on the plurality of segments;

obtaining a plurality of entity matrices based on the NMPCF analysis result;

separating a target instrument signal from the mixed signal separated into the plurality of segments by calculating an inner product between the plurality of entity matrices;

associating the target instrument signals separated from each of the plurality of segments; and converting the associated target instrument signal and the phase information into a signal of the time domain to separate, from the mixed signal, sounds generated using a predetermined rhythm musical instrument.

10. The method of claim 9, wherein the plurality of entity matrices includes a matrix $A_C$ of a frequency element commonly shared by all of the plurality of segments, a matrix $A_C^{(I)}$ of a different frequency element for each of the plurality of segments, an information matrix $S_C^{(I)}$ of the time domain corresponding to $A_C$, and an information matrix $S_I^{(I)}$ of the time domain corresponding to $A_I^{(I)}$.

* * * * *